US007131170B2

(12) United States Patent
Weaver

(10) Patent No.: US 7,131,170 B2
(45) Date of Patent: Nov. 7, 2006

(54) THREADED PUSH BROOM LOCKING CLIP

(75) Inventor: Jace A. Weaver, Gilbertsville, PA (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 694 days.

(21) Appl. No.: 10/608,269

(22) Filed: Jun. 27, 2003

(65) Prior Publication Data

US 2004/0265053 A1 Dec. 30, 2004

(51) Int. Cl.
*A44B 21/00* (2006.01)

(52) U.S. Cl. ..... 24/545; 248/316.7

(58) Field of Classification Search ..... 248/305, 248/231.85, 231.81, 230.7, 228.7, 228.4, 248/228.3, 72, 75, 78, 74.2, 201, 229.15, 248/229.16, 110, 634, 229.12, 316.7; 411/433, 411/437, 539; 24/545; 206/223, 361
See application file for complete search history.

(56) References Cited

U.S. PATENT DOCUMENTS 2,795,834 A * 6/1957 Szoke ..... 248/316.7
3,684,223 A * 8/1972 Logsdon ..... 248/74.3
3,778,537 A * 12/1973 Miller ..... 248/229.26
D264,682 S * 6/1982 Van Doren ..... D8/354
4,550,829 A * 11/1985 Strahs ..... 24/546
5,669,590 A * 9/1997 Przewodek ..... 248/74.2
5,725,185 A * 3/1998 Auclair ..... 248/74.2
5,871,189 A * 2/1999 Hoftman ..... 248/231.81
6,109,569 A * 8/2000 Sakaida ..... 248/316.7
6,715,721 B1 * 4/2004 Buck ..... 248/74.2

* cited by examiner

*Primary Examiner*—Robert J. Sandy
(74) *Attorney, Agent, or Firm*—Stuart M. Goldstein

(57) ABSTRACT

An integrally formed locking clip has a unitary body and downwardly extending lateral side arms. The clip is made of resiliently flexible material which allows the side arms to extend over and around the top support member of a push broom head and attach to the broom head. The clip has an upper section consisting of a threaded opening which is configured to accept and threadably engage the threaded end connection of the handle of the push broom. When so engaged, the handle is securely mounted on and along the longitudinal axis of the broom head. The upper section of the clip may be formed of a closed circular threaded ring or a partially opened threaded cradle.

12 Claims, 4 Drawing Sheets

THREADED PUSH BROOM LOCKING CLIP

BACKGROUND OF THE INVENTION

Push brooms have long been used as an effective cleaning tool. The standard push broom consists of a separable elongated handle and a brush or cleaning head. Usually the brush head is made up of bristles and a rigid bristle supporting base, often made of wood, plastic, light metal, or other hard material. The base routinely has two centrally located holes in its upper surface for receiving the handle. One hole is located on one side of the head and the second hole is located on the other side of the head. This allows the handle to be switched from one hole to the other, when the bristles become worn in one pushing direction. The holes are threaded to allow engagement with the end of the handle which has corresponding threads. The handle is easily screwed into the base in the cleaning use mode of the broom.

However, while this handle and cleaning head configuration provides a functional push broom, shipping, transport, and merchandising of these brooms presents a problem. Distribution of push brooms, when forwarded from the manufacturer to wholesalers, retailers, and vendors already connected in the cleaning use mode, i.e., with the handle secured to the threaded hole in the head, results in a cumbersome, awkward and difficult situation. Shipping brooms in this fashion also takes up valuable cargo and container space. Displaying assembled push brooms for retail merchandising and sale presents the same handling and spatial problems.

Push broom manufacturers have attempted to address these problems by shipping their brooms with the handles and heads separated and attached side by side. Handles and heads are attached with their respective longitudinal axii in parallel relationship. While this has, to a large extent, solved the handling and spatial problems, actually attaching the handles and heads so that they remain secured during transport and shipment and then during the merchandising and display process continues to be a problem. Handles and heads routinely become separated between the time of shipment from the manufacturer to the ultimate sale to the consumer. This causes inconvenience and inefficiency during transport, results in debris and waste from separated broom components and wrappers, leads to actual loss of components, and presents unattractive merchandising displays—all resulting in a general and substantial loss of sales.

In the past, manufacturers have attempted to attach push broom head and handles for transport and merchandising by means of string or twine, twist ties, and a variety of plastic and metal clips. One such spring clip type device is disclosed in U.S. Pat. No. 4,550,829. However, none of the prior broom handle to head attaching means which are designed exclusively and solely for attaching broom heads to handles for transport and merchandising purposes provides a system to guarantee an effective, practical, and economical system, which allows for the transport and merchandising of a push broom without handle to head separation.

SUMMARY OF THE INVENTION

It is thus the object of the present invention to overcome the limitations and disadvantages of prior push brooms and hand cleaning push tools.

It is a general object of the present invention to provide an efficient, effective, and economical means of securing the handle of a push broom to its broom head during the transport and merchandising of the push broom.

It is another object of the present invention to provide a push broom locking clip which will effectively and efficiently secure a push broom handle to the broom head, without risk of separation during transport and merchandising of the push broom.

It is a further object of the present invention to provide a push broom locking clip which uses the threaded end connection of the push broom to secure the handle to the broom head during transport and merchandising of the broom.

It is still a further object of the invention to provide an efficient, effective, and economic means of securing the push broom handle to the cleaning head in order to save valuable cargo and container space, to ensure distribution and sale efficiency, to prevent loss of broom components during transport and merchandising, and to save resources needed to produce and dispose of non-reusable handle to head connectors.

These and other objects are accomplished by the present invention, an integrally formed locking clip. The clip has a unitary body and downwardly extending lateral side arms. The clip is made of resiliently flexible material which allows the side arms to extend over and around the top support member of a push broom head and attach to the broom head. The clip has an upper section consisting of a threaded opening which is configured to accept and threadably engage the threaded end connection of the handle of the push broom. When so engaged, the handle is securely mounted on and along the longitudinal axis of the broom head. The upper section of the clip may be formed of a closed circular threaded ring or a partially opened threaded cradle.

The novel features which are considered as characteristic of the invention are set forth in particular in the appended claims. The invention itself, however, both as to its design, construction, and use, together with additional features and advantages thereof, are best understood upon review of the following detailed description with reference to the accompanying drawings.

DETAILED DESCRIPTION OF THE INVENTION

Figure 1:
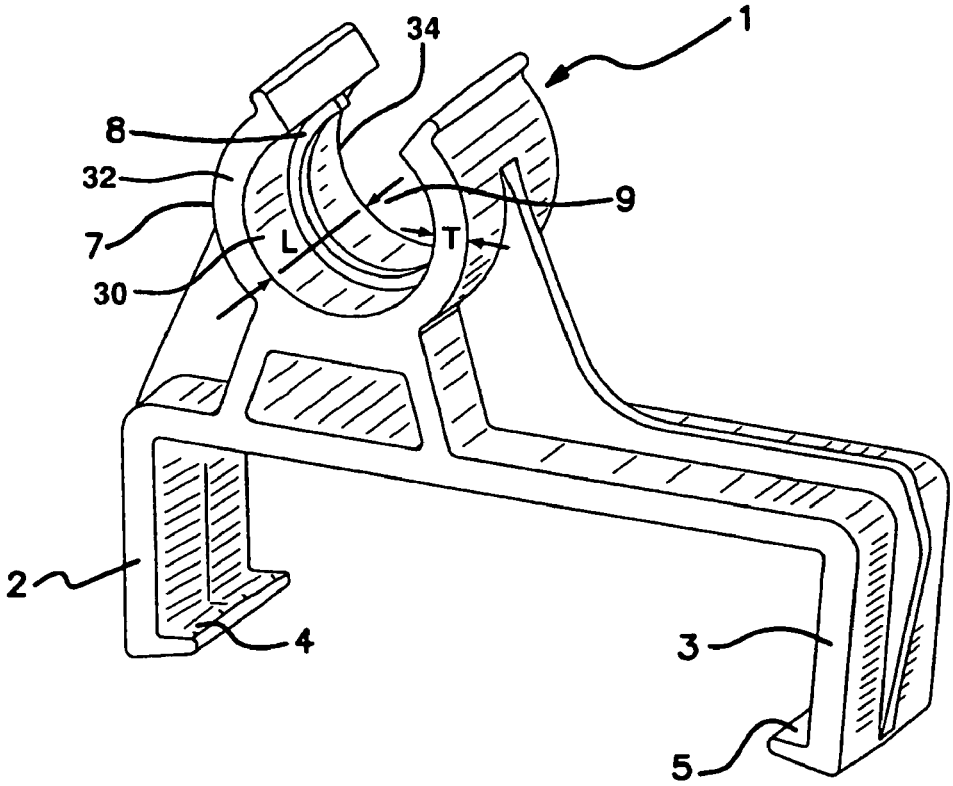
FIG. 1 shows the push broom locking clip of the present invention.

Push broom locking broom clip 1, shown in FIG. 1, is a unitary body comprising downwardly extending side arms 2 and 3 with inwardly extending lips 4 and S respectively. The upper section of clip 1 comprises partially open cradle 7 with thread 8 and opening 9. Thread 8 extends radially inward from and alone interior surface 30 of cradle 7. The dimensional length L of interior surface 30 extends from curvilinear front surface 32 of cradle 7 to rear surface 34 of the cradle. As best seen in FIG. 1, the dimensional length L of interior surface 30 is greater than the dimensional thickness T of front surface 32. Clip 1 is an integral unit made of resiliently flexible material, such as molded plastic.

Figure 2:
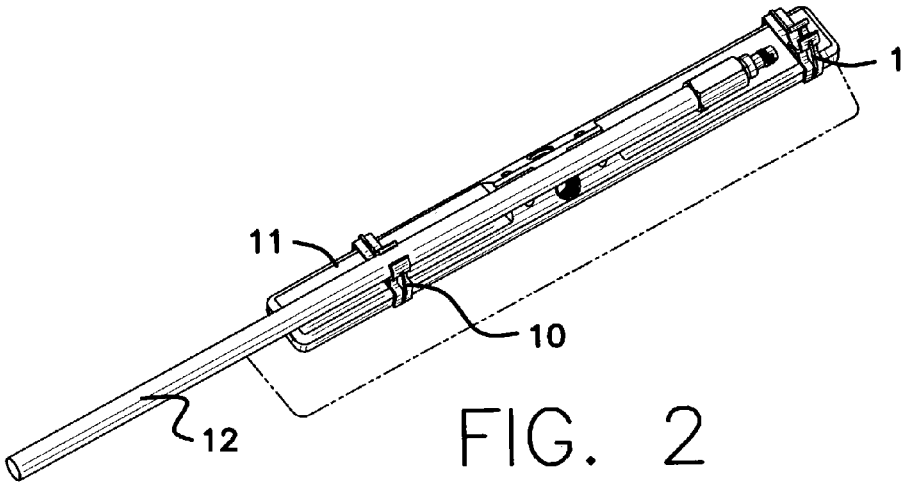
FIG. 2 shows the positioning of the handle of a push broom on the broom head, prior to the handle being secured within the locking clip of the present invention.
Figure 3:
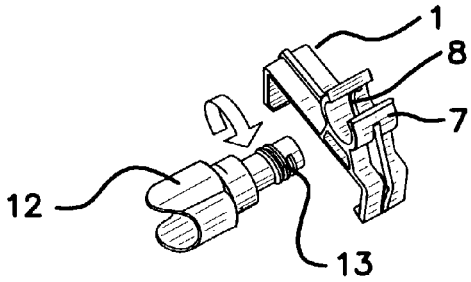
FIG. 3 shows the manner in which the threaded end connection of the handle is secured within the locking clip of the present invention.
Figure 4:
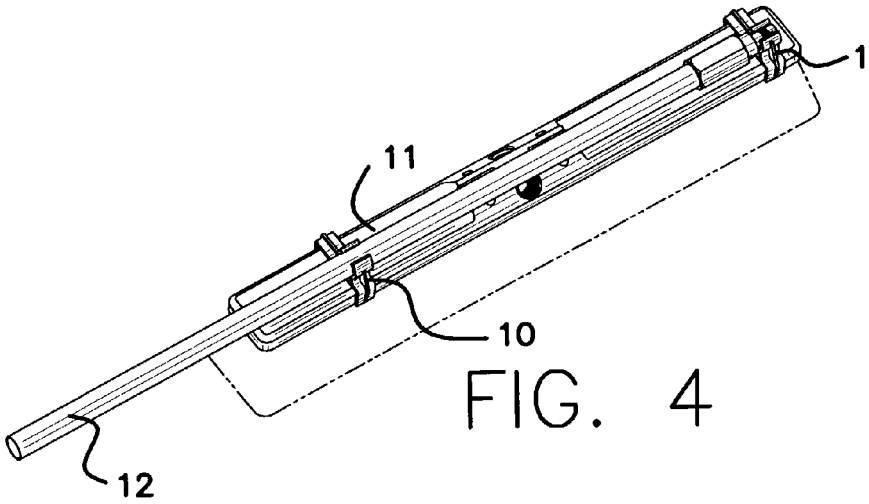
FIG. 4 shows the handle secured in position on the broom head, within the clip of the present invention.

In use, clip 1 is mounted on broom head 11 by placing the clip over the top of the support member of the head and slightly extending side arms 2 and 3 outward. As side arms 2 and 3 close over and around the top of head 11, lips 4 and 5 secure the clip onto the head, as seen in FIG. 2. Push broom handle 12 is then aligned along the longitudinal axis of head 11 and positioned in alignment clip 10. Clip 10 has an upper section of cradle-like configuration and is secured to head 11 in a similar manner as clip 1 is secured to the head 11. After handle 11 is positioned in clip 10, it is slid along the top of head. When handle 12 reaches clip 1, threaded end connector 13 of the handle is turned about thread 8 within opening 9 of cradle 7 of the clip, becoming threadably engaged therein. This securely attaches handle 12 on and along the longitudinal axis of head 11.

Figure 5:
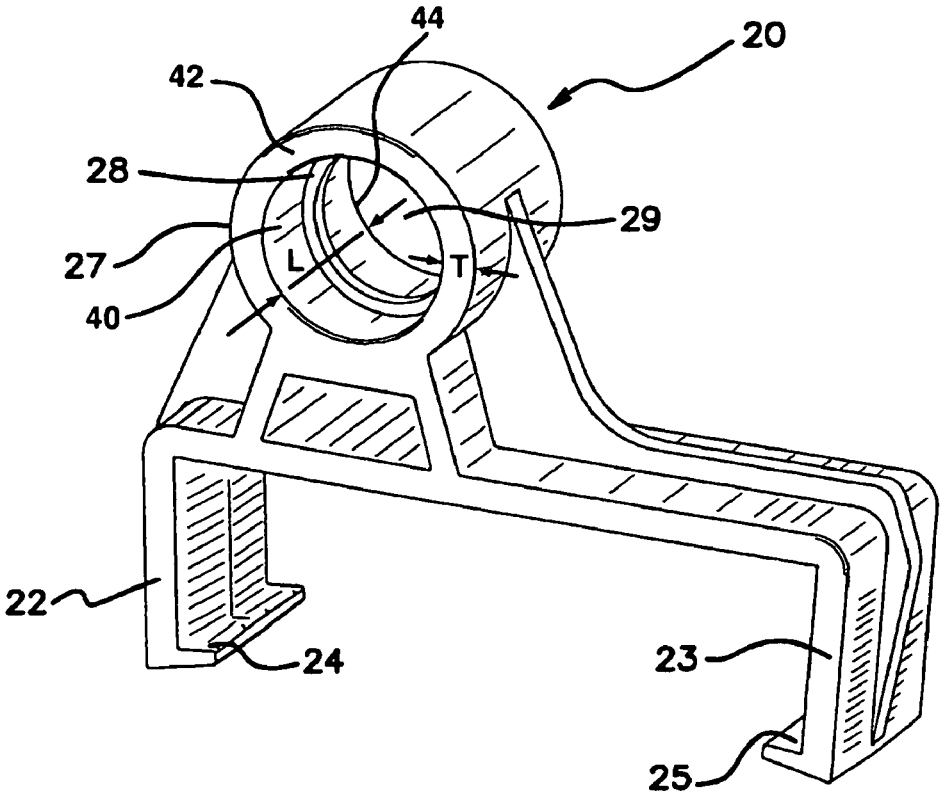
FIG. 5 shows an alternate embodiment of the push broom locking clip of the present invention.

FIG. 5 shows an alternate embodiment of the locking clip of the present invention. Clip 20 is also a unitary body comprising downwardly extending side arms 22 and 23 with inwardly extending lips 24 and 25 respectively. The upper section of clip 20 comprises ring 27 with thread 28 and opening 29. Thread 28 extends radially inward from and along surface 40 of ring 27. The dimensional length L of interior surface 40 extends from curvilinear front surface 42 of ring 27 to rear surface 44 of the ring. As best seen in FIG. 5, the dimensional length L of interior surface 40 is greater than the dimensional thickness T of front surface 42. Clip 20 is an integral unit, made of resiliently flexible material, such as molded plastic.

Figure 6:
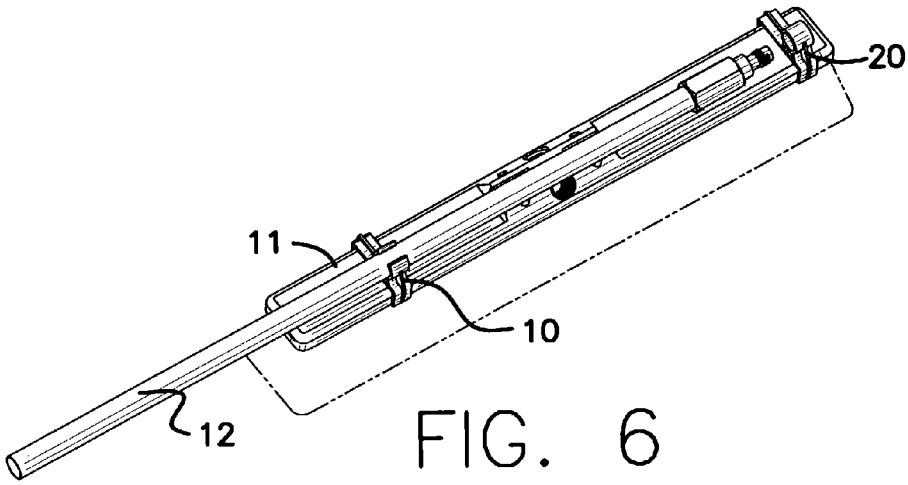
FIG. 6 shows the positioning of the handle of a push broom on the broom head, prior to the handle being secured within the locking clip of the present invention.
Figure 7:
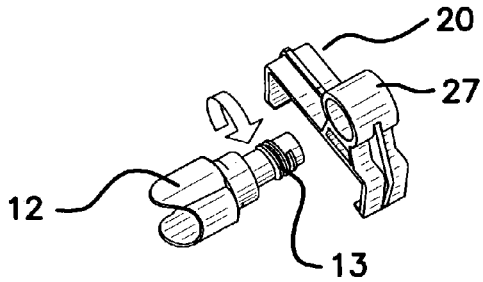
FIG. 7 shows the manner in which the threaded end connection of the handle is secured within the locking clip of the present invention.
Figure 8:
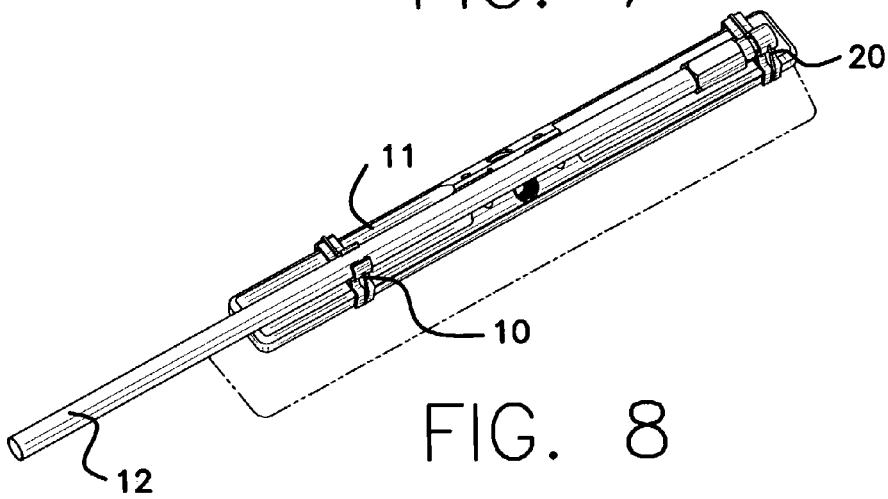
FIG. 8 shows the handle secured in position on the broom head, within the clip of the present invention.

In use, clip 20 is mounted on broom head 11, by placing the clip over the top of the support member of the head and slightly expanding side arms 22 and 23 outward. As side arms 22 and 23 close over and around the top of head 11, lips 24 and 25 secure the clip onto the head, as seen in FIG. 6. Push broom handle 12 is then aligned along the longitudinal axis of head 11 and positioned in alignment clip 10, described with reference to the previous embodiment. After handle 11 is positioned in clip 10, it is slid along the top of head 11. When handle 12 reaches clip 20, threaded end connector 13 of the handle is turned about thread 28 within opening 29 of ring 27 of the clip, becoming threadably engaged therein. This securely attaches handle 12 on and along the longitudinal axis of head 11.

The locking clip of the present invention allows for an effective and efficient means of securing a push broom handle to its broom head, from transport and merchandising, without risk of separation. The clip also allows for the easy and ready removal by the consumer of the push broom handle from the transport/merchandising mode in which the push broom is distributed by the manufacturer. The consumer can simply convert the push broom to the cleaning use mode by removing the handle from the head and threadably engaging it into one of the threaded connection holes in the head.

When transporting the push broom, the consumer can also convert from the cleaning use mode by removing the handle from the threaded hole in the head and replacing the handle over the head, within the locking clip, once again.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A clip for securing a handle with a threaded end connector to a broom head with a longitudinal axis, said clip comprising:

(a) a unitary clip body;

(b) means to attach the body to the broom head;

(c) a handle end connector support comprising a curvilinear front surface of given dimensional thickness and an interior surface of given dimensional length extending from the front surface, the dimensional length of the interior surface being greater than the dimensional thickness of the front surface; and (d) at least one thread located within the support extending radially inward from and along the interior surface, said support further comprising opening means to receive the threaded end connector, whereby when the end connector is received within the opening means, it is configured to be threadably engaged with said at least one thread to immovably secure the handle along the longitudinal axis of the broom head.

2. The clip as in claim 1 wherein the support is a cradle comprising upstanding arms forming a partially open ring.

3. The clip as in claim 1 wherein the support comprises a closed cylindrically shaped ring.

4. The clip as in claim 1 wherein the clip is an integrally molded element.

5. The clip as in claim 1 wherein the means to attach the body to the broom head comprises downwardly extending side arms.

6. The clip as in claim 1 wherein the unitary clip body of the clip is made of resiliently flexible material.

7. A system for securing an elongated handle with a threaded end connector to a broom head with a longitudinal axis, said system comprising:

(a) a plurality of handle clips, each clip comprising a unitary body and means to attach the body to the broom head;

(b) one of the plurality of handle clips having opening means to receive and support the elongated body of the handle;

(c) one of the plurality of broom clips having a handle end connector support comprising a curvilinear front surface of given dimensional thickness and an interior surface of given dimensional length extending from the front surface, the dimensional length of the interior surface being greater than the dimensional thickness of the front surface; and (d) at least one thread located within the support extending radially inward from and along the interior surface, said support further comprising second opening means to receive the threaded end connector;

whereby when the elongated body of the handle is supported in the opening means by one of the plurality of handle clips and when the end connector is received within the second opening means, the end connector is configured to be threadably engaged, with said at least one thread to immovably secure the handle along the longitudinal axis of the broom head.

8. The system as in claim 7 wherein the support is a cradle comprising upstanding arms forming a partially open ring.

9. The system as in claim 7 wherein the support comprises a closed, cylindrically shaped ring.

10. The system as in claim 7 wherein each of the handle clips is an integrally molded element.

11. The system as in claim 7 wherein the means to attach the body to the broom head comprises downwardly extending side arms.

12. The system as in claim 7 wherein the unitary clip bodies of the clips are made of resiliently flexible material.

* * * * *